US005601056A

United States Patent [19]

Kuhn et al.

[11] Patent Number: 5,601,056

[45] Date of Patent: Feb. 11, 1997

[54] DEVICE FOR ACTUATING THE VALVES IN INTERNAL COMBUSTION ENGINES BY MEANS OF REVOLVING CAMS

[76] Inventors: Peter Kuhn, Prankolstrasse 61, D-6940 Weinheim; Gerhard Kachel, Weltzienstässe 7; Helmut Schon, Rheingoldstrasse 2, both of D-7500 Karlsruhe, all of Germany

[21] Appl. No.: 540,929

[22] Filed: Oct. 11, 1995

Related U.S. Application Data

[63] Continuation of Ser. No. 232,136, filed as PCT/DE92/00899 Oct. 23, 1992 published as WO93/08377 Apr. 29, 1993, abandoned.

[30] Foreign Application Priority Data

Oct. 25, 1991 [DE] Germany ..... 41 35 257.2

[51] Int. Cl.[6] ..... F01L 1/08; F01L 1/12; F01L 13/00

[52] U.S. Cl. ..... 123/90.16; 123/90.17; 123/90.6

[58] Field of Search ..... 123/90.15, 90.16, 123/90.17, 90.2, 90.27, 90.48, 90.6

[56] References Cited

U.S. PATENT DOCUMENTS

| | | | |
|---|---|---|---|
| 4,138,973 | 2/1979 | Luria | 123/90.16 |
| 4,538,559 | 9/1985 | Imamura et al. | 123/90.6 |
| 4,572,118 | 2/1986 | Baguena | 123/90.16 |
| 4,651,684 | 3/1987 | Masuda et al. | 123/90.16 |
| 4,942,854 | 7/1990 | Shirai et al. | 123/90.6 |
| 5,119,773 | 6/1992 | Schon et al. | 123/90.16 |
| 5,165,370 | 11/1992 | Beaumont | 123/90.16 |
| 5,189,998 | 3/1993 | Hara | 123/90.16 |

FOREIGN PATENT DOCUMENTS

| | | | |
|---|---|---|---|
| 2103272 | 3/1972 | France . | |
| 2915787 | 10/1980 | Germany | 123/90.27 |
| 3833540 | 4/1990 | Germany . | |
| 129729 | 8/1979 | United Kingdom . | |

*Primary Examiner*—Weilun Lo
*Attorney, Agent, or Firm*—Baker & Daniels

[57] ABSTRACT

A device for actuating a valve in an internal combustion engine consists of a casing and a cam mechanism including a cam which is rotatably joined to the casing. The cam engages a tappet at a cam/tappet interface and the tappet engages a output link at a tappet/drive link interface. During cam rotation, the cam causes an acceleration to occur in the output link. The drive link moves alternately in either of two directions and is operably disposed within the casing so that the drive link transmits its motion to the valve. The cam is shaped such that in the interval between valve closure and reopening, the acceleration transmitted by the cam, at the cam/tappet interface in normal direction, is substantially constant and is directed away from the cam. During portions of the cycle of operation, the various mechanical links are kept in contact solely by the effect of inertial force thereby reducing the need for additional springs, such as commonly used to maintain contact between the intermediate link or tappet and the cam. A support element or stop engages the output link during valve closure such that the drive link does not engage the tappet at the tappet/drive link interface. This provides more linear acceleration and enhanced lubrication at the tappet/drive link interface during engine operation.

15 Claims, 3 Drawing Sheets h
1
11
5
6
3
9
8
10
0°
360°
φ
2
4
12
7 b
13
15
14
15
0°
360°
φ
2
4

DEVICE FOR ACTUATING THE VALVES IN INTERNAL COMBUSTION ENGINES BY MEANS OF REVOLVING CAMS

This is a continuation of application Ser. No. 08/232,136, filed as PCT/DE92/00899 Oct. 23, 1992 published as WO93/08377 Apr. 29, 1993, now abandoned.

BACKGROUND OF THE INVENTION

The present invention concerns a device for actuation of the valves in reciprocating internal combustion engines.

For actuation of valves with a nonvariable valve stroke there are prior cam dwell linkages with three and more links, which are popular in today's reciprocating piston engines. For actuation of valves with variable valve stroke there are prior cam dwell linkages as well with four and more links (compare DE-OS 38 33 540 and PCT-FR 82/00221). All of these valves are actuated by cams which interact with a further link whose motion is transmitted to the valve through additional links.

Regarding the valve actuation devices for internal combustion engines as described in said patent disclosure, two aspects have evolved which are to be considered as worthy of improvement. One concerns the problem of the motion transmitted by the cam to the drive links, that is, to the tappets and the acceleration during the interval between the "closing" and "opening" of the valve. The other concerns a tribological problem, i.e., optimizing the intermediate link, typically a tappet, transmitting the rotary cam motion as a linear motion to the valves in terms of friction and lubrication. With an appropriate design of the mechanism, both partial problems can be solved in a device of the categorial type, resulting in an internal combustion engine with greater efficiency and extended service life.

As to the aforementioned problem regarding tappet acceleration, in the operation of the internal combustion engine, losing the contact between tappet and cam in the interval between "closing" and "opening" of the valve, i.e., when the valve is at rest, has proved to be disadvantageous in view of noise emission and material stress. This problem is not new though, and it has so far been solved by keeping the tappet in contact with the cam by means of a spring mechanism. However, this solution is not optimal in view of engineering expense and additional space needs.

Consequently, the problem underlying the invention is to improve cam follower linkages with three and more links such as used to drive the valves of internal combustion engines in view of noise emission and material stress without raising the engineering expense.

Regarding the problem of friction and lubrication, it has been demonstrated in view of the mechanism described in DE-OS 38 33 540 that increased friction occurs at the contact points between the intermediate link or tappet and the casing and of the intermediate link and output link during the valve closed period. Furthermore, the existence of unfavorable lubrication conditions due to the constant nonpositive connection at the contact point of the intermediate link and output link has been evidenced.

SUMMARY OF THE INVENTION

As regards the problem concerning tappet acceleration and the contact between tappet and cam, the link actuated directly by the cam via a cam interface is held in constant contact with the cam by the specific cam shape and the inertial force of the tappet. Thus, the cam shape is characterized by exclusively positive tappet acceleration in the direction of valve opening at least approximately through the entire interval between the "closing" of the valve and its "reopening", with the tappet thus being forced on the cam by its inertia. "Positive acceleration" in the direction of valve opening means that the tappet positively accelerates in the valve opening direction (i.e., away from the cam) and decelerates in the valve closing direction (i.e., toward the cam).

When the tappet is the transmitting link between the rotary motion of the cam and the rotary and thrust motions of the output link transmitting the motion to the valve, and when this transmission of motion necessitates a further cam joint on the tappet, freedom of motion of the tappet in the interval of valve closure needs to be ensured. The above mentioned document DE-OS 38 33 540 describes such mechanisms for variable valve actuation in reciprocating piston engines.

To help in maintaining the contact in the interface between cam and tappet, the output link bears, during the valve closed interval, on the valve and directly on the casing. The tappet is thus able to move nearly without any friction in the direction of joint freedom of the interface between the tappet and output link.

The tappet backing on the casing side overlaps the tappet during the valve closure period and functions as a stop to abut the output link directly thereby permitting the tappet to float. Owing to the short paths of force in this backing support lever, a very limited lash in the range of valve dwell is achievable between the output link and tappet and between the tappet and casing, and the tappet is able to move nearly without friction.

BRIEF DESCRIPTION OF THE DRAWINGS

The invention will be more fully explained hereafter with the aid of the drawings, which show in FIG. 1 a typical progression of the valve and tappet stroke through a complete cam rotation by 360°, firstly according to the prior art and also according to the invention.

DETAILED DESCRIPTION

Figure 1:
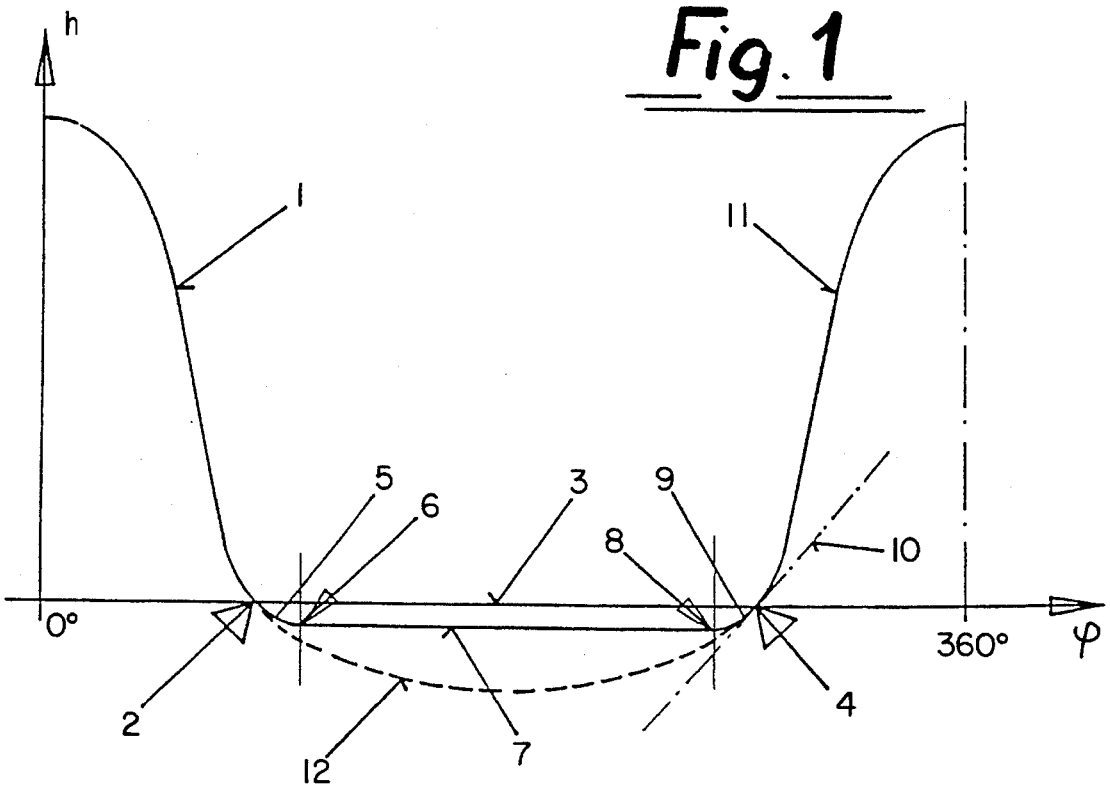

FIG. 1 shows a typical progression of the valve stroke and of the stroke of the link driven by the cam, hereafter referred to as the tappet, over the angle of action $\psi$ for a full cycle of 360°. Starting from the position of maximum valve stroke, the valve stroke and tappet stroke decrease equally in accordance with curve section 1. At 2, the valve seats itself on its seat, and its motion follows the curve section 3, a straight line, until reaching point 4. From point 2, valve and tappet differ in their progressions of motion; the tappet follows the cam along section 5 up to point 6. In this range the tappet remains in contact with the cam, since a positive acceleration (i.e., deceleration in the valve closing direction) is given in cam section 5. This is no longer the case after point 6, and the tappet will in the further course assume a position between curve sections 3 and 7 which is given by the base circle of the cam. The course of the tappet motion between curve sections 3 and 7 depends on a number of disturbance factors, such as engine vibrations, and cannot be predicted.

If the tappet perchance now follows line 7, thus bearing on the cam base circle, it is not accelerated along line 7 and is then accelerated from point 8 and along cam section 9, reaching at point 4 the velocity illustrated by the rise of tangent 10. From point 4 on, the tappet entrains the valve and both continue moving along curve section 11.

Thus, the valve must at point 4 be accelerated abruptly to the velocity of the tappet, which is unfavorable as regards material stress and noise.

If the tappet now coincidentally follows curve section 3, hence bearing on the valve, not only the valve but also the tappet needs to be accelerated abruptly at point 4 to the velocity illustrated by the rise of tangent 10. The conditions regarding material stress and noise are thus considerably more unfavorable than in the former case. To obtain now more favorable conditions such as in the former case, it is obviously necessary to keep the tappet in constant contact with the cam. As discussed above, this is achieved in the prior art by means of a spring.

The progression of the tappet stroke attained during said interval with the inventional cam shape is shown by curve section 12 in FIG. 1. Thus, the entire progression of valve stroke follows curve sections 1, 3 and 11, while the progression of tappet stroke follows curve sections 1, 12 and 11.

Since all that matters is keeping the tappet in constant contact with the cam, a small acceleration in relation to the greatest acceleration that occurs is sufficient, which is illustrated by the relatively slight curvature of cam section 12. Since on the one hand a certain minimum acceleration is necessary in cam section 12, whereas on the other hand a higher acceleration only would result in useless friction, an approximately evenly low acceleration is suitable in cam section 12. The relationship represented in cam section 12 of FIG. 1 provides the proper level of acceleration necessary to maintain contact between the cam and the tappet during valve closure. A mechanical structure for effectuating tappet dynamics characterized by the shape of curve 12 is described below in the detailed description relating to FIGS. 3, 4A, and 4B.

Figure 2:
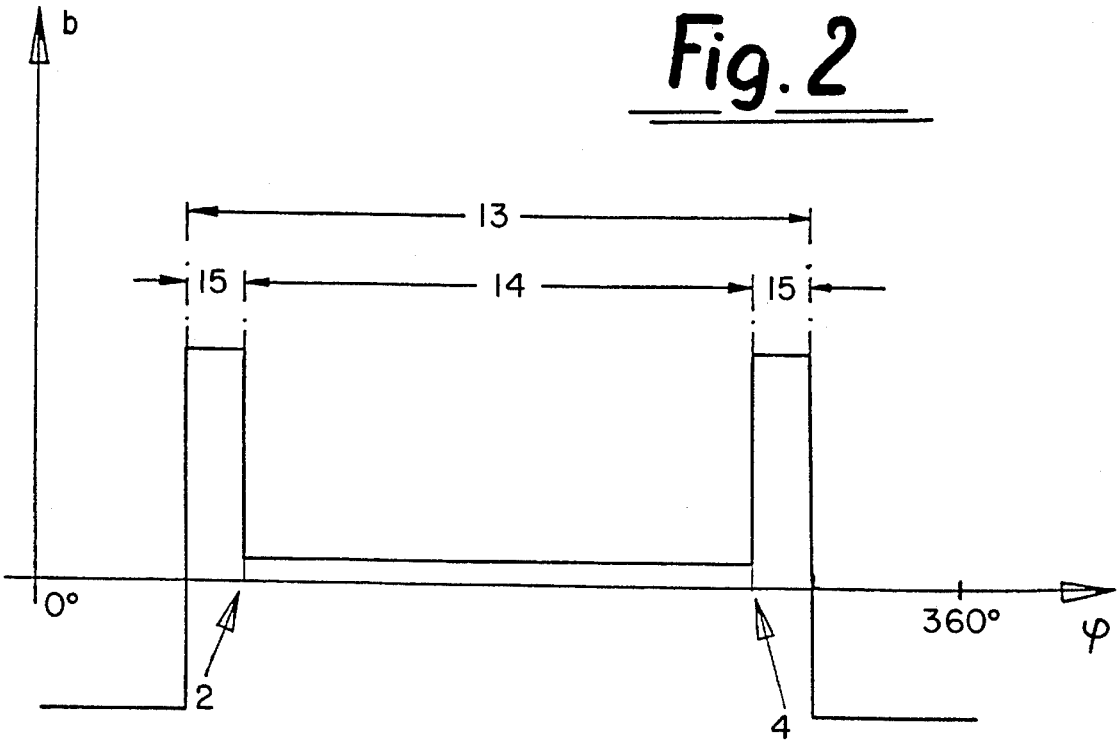
FIG. 2, the progression of tappet acceleration according to the present invention.

To achieve smooth running, the two high acceleration ranges on the cam flanks are favorably joined seamlessly to the range of low tappet acceleration coinciding with valve closure, so that there exists a single interval with exclusively positive and constant tappet acceleration. The progression of tappet acceleration according to the invention thus created is plotted in FIG. 2 over the angle of action of the cam 23. Interval 13 with exclusively positive acceleration in the valve opening direction is composed of a center section 14 with low essentially constant acceleration and two sections 15 of high acceleration in the marginal ranges of the interval.

The illustrated progression of acceleration can be modified to an equivalent progression which is free of jumps. Furthermore, the inventional progression of motion may be applied not only to a linear motion of a tappet guided in a thrust joint, but also to a rotary motion of a rocker or drag lever guided by a pivot point.

The part described so far of the present invention thus concerns the nonpositive connection between tappet and cam with the valve closed and has a positive effect in view of material stress and smooth running of a mechanism equipped with a cam acting in accordance with the invention. As regards material stress further measures for enhancing valve operation are provided for. These are based on a mechanism of the kind described in DE-OS 38 33 540, where the conditions regarding friction and lubrication are meant to be improved so as to augment the mechanical efficiency of the engine, for one, and reduce the wear in the valve mechanism, for another.

The solution to this problem involves providing a mechanism where the output link 25 bears during the valve closure interval in such a way on the casing that a definitive lash is produced between the output and tappet 24 and/or between the tappet 24 and the casing. As a result, the tappet 24 is able to move extensively freely during the valve closure interval, keeping the tappet in constant contact with the cam 23 and allowing the lubrication film to regenerate in the unstressed contact point between tappet 24 and output link 25.

The support of the output link 25 on the casing side, during valve closure, is on the same component which in the casing provides in a suitable manner guidance for the tappet 24 on the casing side. An embodiment of a mechanism with the "overhead" support is illustrated in FIG. 3.

Figure 3:
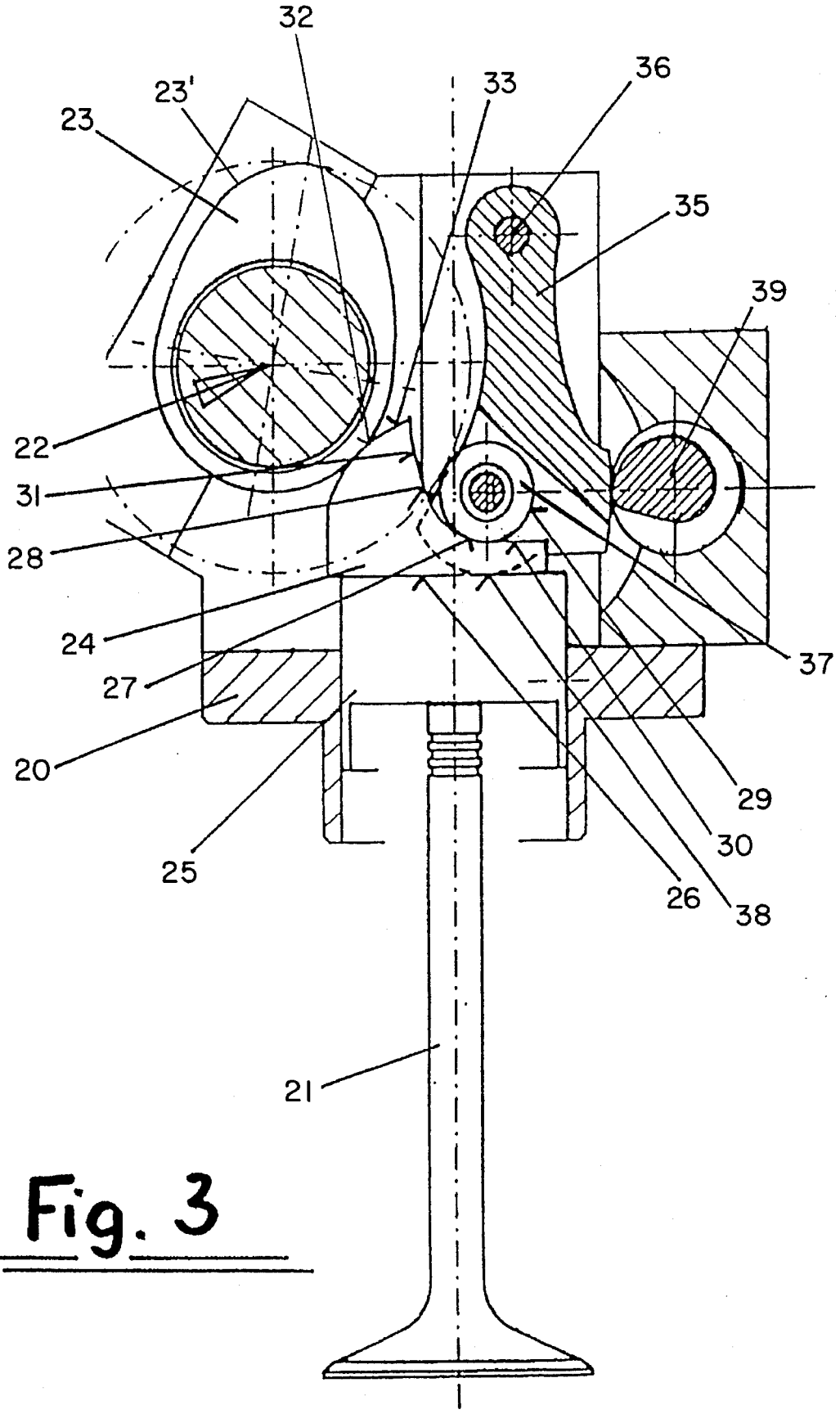
FIG. 3, a sectional view of a first embodiment of the invention, with backing to provide intermediate link relief during valve dwell.

Partly in side elevation, FIG. 3 depicts a casing 20 with a valve 21. The valve 21 is driven by a cam 23 fitted on a pivot 22, the shape 23' of which cam preferably has on the tappet 24 the effect described with the aid of FIGS. 1 and 2. Cam 23, casing 20 and the approximately triangular tappet 24 are parts of a four-link mechanism whose fourth link is formed by a cup type slide 25 acting as the output link to impart motion to valve 21. Conventionally, valve 21 is maintained in a closed position by a biasing spring (not shown) until the biasing force is overcome by the force imparted by output link 25. Forming between tappet 24 and cup type slide 25, through linear slide faces, is a thrust joint or interface 26. Tappet 24 bears on the casing via roller/tappet interface 27 which is formed between one side of tappet 24, fashioned as tappet roller follower surface 28, and roller surface 29. Roller surface 29 is shown as the cylindrical surface of roller 37 which is mounted on casing 20. Tappet roller follower surface 28 is composed of linear portion 30 and contoured portion 31. In conjunction with cam 23, linear portion 30 effects valve closure and contoured portion 31 effects valve opening and governs valve lift. The valve stroke curve may be varied by changing the position of the roller/tappet interface 27 between tappet 24 and casing 20, essentially in the direction of thrust of tappet/output link interface 26 between tappet 24 and cup type slide 25, or by positional change of pivot 22 between cam 23 and casing 20 in the desired direction.

The mechanism of FIG. 3 only to the extent described so far pertains to the prior art. According to the present advancement in view of improving the contact situation at the cam/tappet interface 32 between cam 23 and tappet 24, the cup type slide 25 bears during the valve closure interval directly on the casing 20. In terms of design, this is accomplished by providing a lever 35 supporting a roller 37 that overlaps the tappet 24 and supports with its arcuate stop 38, which is fashioned as a cylindrical recess, the cup type slide 25 during the valve closure interval. To vary the curve of valve stroke, lever 35 itself is rotatably supported on the casing by pivot 36. Movement of lever 35 will vary the position of roller 37 and stop 38. The depicted adjustment mechanism (35, 36, 39) is illustrated only as an example and may be replaced by suitable variants. Because the upward motion of output link 25 is limited by stop 38, tappet 24 is free to "float" and remain in contact with the surface of cam 23, which is shaped as shown by curve 12 in FIG. 1.

Figure 4B:
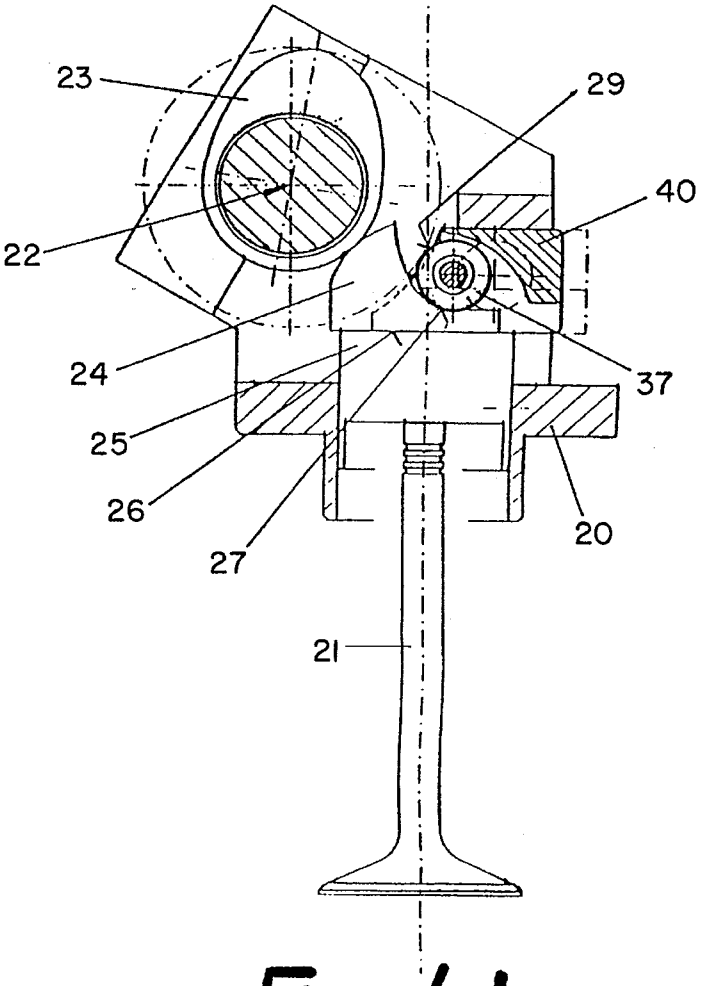
FIGS. 4A and 4B sectional views of a second embodiment of the invention, with backing to provide intermediate link relief during valve dwell.
Figure 4A:
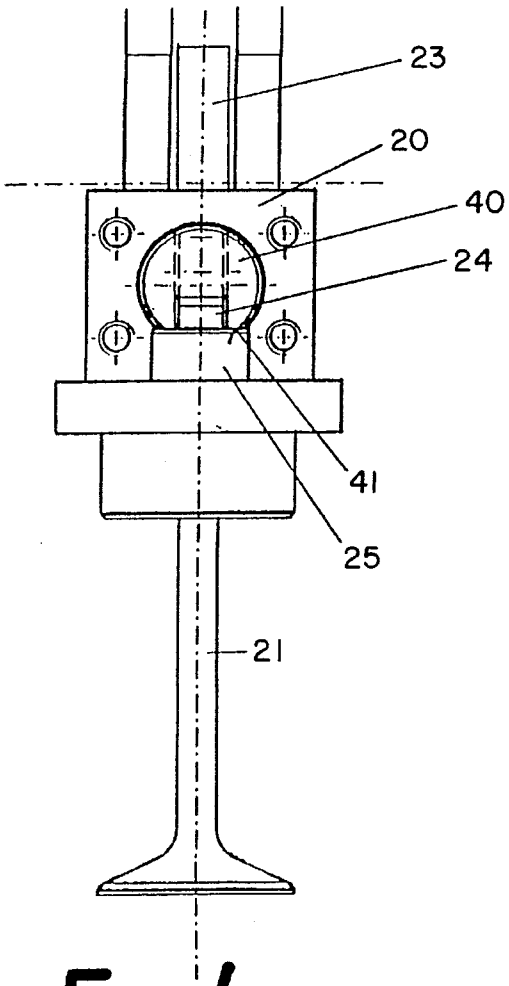

FIGS. 4A and 4B show in two sectional illustrations a second embodiment in which the position of roller tappet interface 27 between tappet 24 and roller surface 29 on the casing side is variable exactly in the thrust direction of tappet/output interface 26. Roller 37 runs in a cylindrical slider 40 which in the casing 20 is mounted in a fashion allowing it to move in the thrust direction of tappet/output joint 26. Slider 40 overlaps the tappet 24 and supports the cup type slide 25 during valve closure on the face 41.

The embodiments shown in FIGS. 3 and 4 for supporting the output link during valve closure should be understood only as examples.

The conditions allow appropriate transfer if the joints between the output link and casing and between the tappet and output link are fashioned as revolute joints. Similarly, such output link support during valve dwell can also be established in case of a positional change of the revolute joint between cam and casing for the purpose of varying the curve of the valve stroke.

We claim:

1. A device for actuating a valve in an internal combustion engine, said device comprising:

a casing;

a stop connected to said casing;

a cam rotatably attached to said casing;

a tappet driven by said cam;

an output link movably associated with said casing and disposed between said tappet and valve whereby the output link motion is transmitted to the valve; and said cam and tappet forming a cam/tappet interface wherein said cam causes a positive acceleration to occur on said tappet and said output link, said cam shaped such that in the interval between valve closure and reopening the positive acceleration is essentially constant, the positive acceleration being away from said cam and toward a valve opening direction, said output link engaging said stop permitting said tappet to become free floating during said interval, wherein said tappet at least momentarily is free to move with respect to said cam and said output link and is permitted to maintain contact with said cam due to inertial forces.

2. The device of claim 1, wherein in the interval between valve closure and reopening the positive acceleration is less than a maximum acceleration associated with the valve.

3. The device of claim 2, wherein said cam is shaped such that no abrupt point occurs in the course of acceleration.

4. The device of claim 2, wherein said cam is shaped such that within one cam revolution there occurs only a single interval of positive acceleration.

5. The device of claim 4, wherein said cam is shaped such that no abrupt point occurs in the course of acceleration.

6. The device of claim 1, wherein said cam is shaped such that within one cam revolution there occurs only a single interval of positive acceleration.

7. The device of claim 1, wherein said cam is shaped such that no abrupt point occurs in the course of acceleration.

8. A device for variable actuation of a valve in an internal combustion engine, said device comprising:

a casing;

a cam rotatably attached to said casing;

an output link movably associated with said casing and disposed between said cam and valve whereby the output link motion is transmitted to the valve; and an intermediate link disposed between said cam and said output link which engages said cam at a cam/intermediate link interface, engages said output link at an intermediate link/output link interface, and operably engages said casing through the intermediary of a roller, said cam shaped such that during a valve closure period, defined by the interval between valve closure and reopening, said cam causes a positive acceleration to occur on said intermediate link, the positive acceleration being away from said cam and toward a valve opening direction, the positive acceleration being essentially constant during said interval, said output link bearing on the valve in the valve opening direction during said valve closure period, said output link being disengaged from said intermediate link and bearing on a separate stop element in a direction opposite the valve opening direction permitting said intermediate link to become free floating during said valve closure period, wherein said intermediate link is at least momentarily free to move with respect to said cam and said output link and is permitted to maintain contact with said cam due to inertial forces.

9. The device of claim 8, wherein said cam is shaped such that no abrupt point occurs in the course of acceleration.

10. The device of claim 8, wherein in the interval between valve closure and reopening the positive acceleration is less than a maximum valve acceleration.

11. The device of claim 8, wherein said cam is shaped such that within one cam revolution there occurs only a single interval of positive acceleration.

12. The device of claim 11 wherein said cam is shaped such that no abrupt point occurs in the course of acceleration.

13. In an internal combustion engine comprising a cylinder, a valve, an output link, a cam, a tappet, and a support member having a stop, a method for actuating the valve consisting of the following steps:

causing the cam to rotate such that the cam engages and imparts a force upon the tappet, the cam force causing the tappet to move in a first valve opening direction, upon further rotation the cam nose discontinues imparting a positive force upon the tappet, whereby the tappet is otherwise free to move;

providing the tappet with a shape such that as the tappet moves in the first valve opening direction the tappet engages with and imparts a force on the output link causing the output link to move in a second valve opening direction;

communicating the force of the output link to the valve such that as the output link moves in the second valve opening direction the output link force causes the valve to open with respect to the cylinder and upon the removal of the output link force the valve returns to a closed position; and limiting the movement of the output link by bringing the output link in contact with the support member stop, wherein a lash is produced and the tappet is free to move according to its inertial force relative to the cam and the support member approximately during the period when the valve is closed, the tappet maintaining contact with the cam during the valve closed period due to inertial force.

14. The method of actuating a valve of claim 13, wherein in a period just prior to the opening of the valve the inertial force of the tappet effects a positive acceleration of the tappet toward the first valve opening direction prior to being acted upon by the cam.

15. The method of claim 13 wherein during the valve closed interval, the cam imparts substantially constant positive acceleration to the tappet in the valve opening direction.

* * * * *